US006421890B1

(12) United States Patent
Biggar

(10) Patent No.: US 6,421,890 B1
(45) Date of Patent: Jul. 23, 2002

(54) MODULAR STORAGE SYSTEM FOR STORING CREMATED REMAINS

(76) Inventor: Curtis L. Biggar, 4400 W. Pine St., Appleton, WI (US) 54915

( * ) Notice: Subject to any disclaimer, the term of this patent is extended or adjusted under 35 U.S.C. 154(b) by 0 days.

(21) Appl. No.: 09/567,782

(22) Filed: May 9, 2000

Related U.S. Application Data

(62) Division of application No. 09/250,531, filed on Feb. 16, 1999, now abandoned.

(51) Int. Cl.[7] ..... A61G 17/00

(52) U.S. Cl. ..... 27/1; 220/23.88; 220/23.83; 52/136

(58) Field of Search ..... 27/35, 1; 220/23.83, 220/23.87, 23.88, 23.89, 500, 507, 23.2, 23.4, 23.6; 206/508, 592; 52/128, 134, 136, 137; D7/608; 248/188.2

(56) References Cited

U.S. PATENT DOCUMENTS

| | | | | | |
|---|---|---|---|---|---|
| 2,513,951 | A | * | 7/1950 | McClellen | 27/1 |
| 3,182,884 | A | * | 5/1965 | Waldorn | 206/592 X |
| 3,726,052 | A | | 4/1973 | Thompson | |
| 3,754,805 | A | * | 8/1973 | Pangburn et al. | 52/136 X |
| 3,898,718 | A | | 8/1975 | Eubank | |
| 3,925,944 | A | * | 12/1975 | Pickel | 52/134 |
| 3,940,894 | A | * | 3/1976 | Nunes | 52/136 X |
| D272,577 | S | | 2/1984 | Dercks et al. | |
| 4,893,385 | A | | 1/1990 | Schrag | |
| 5,287,603 | A | | 2/1994 | Schorman | |
| 5,379,499 | A | | 1/1995 | Jackson | |
| 5,408,786 | A | | 4/1995 | Konno | |
| D369,525 | S | * | 5/1996 | Winters | D7/608 |
| 5,625,933 | A | | 5/1997 | Neuberger et al. | |
| 5,729,921 | A | | 3/1998 | Rojas | |
| 5,740,637 | A | | 4/1998 | Snow | |
| 5,765,269 | A | | 6/1998 | Zarth | |
| D396,749 | S | * | 8/1998 | Ortiz | D7/608 |
| D398,132 | S | | 9/1998 | Thesken | |
| 5,815,897 | A | | 10/1998 | Longstreth | |
| 6,023,822 | A | | 2/2000 | Luebke | |
| 6,161,268 | A | * | 12/2000 | Joseph | 27/35 |

FOREIGN PATENT DOCUMENTS

| | | |
|---|---|---|
| CA | 958243 | 11/1974 |
| CA | 2030813 | 5/1992 |

* cited by examiner

*Primary Examiner*—Jack Lavinder
*Assistant Examiner*—William L. Miller
(74) *Attorney, Agent, or Firm*—Joseph W. Byrne

(57) ABSTRACT

An apparatus for storing urns and/or cremated remains is disclosed. A container which has or forms a vault with an open top. A cover closes the open top, and one or more vault fasteners are provided so the container can be attached to a second container. The vault is configured to hold a plurality of urns side-by-side, and end-to-end. The urns are stored along each of a plurality of sidewalls, or along the periphery, or within the vault. The vault cover is attached with a keyed fastener. The key is used to remove the fastener and to lift the cover from the vault. At least one urn spacer is inside the chamber(s) spaces and locates the urns. The urn spacer may be stamped, and the stamped portion used for a memorial plaque. The container is cylindrical or polygonal (three, four, five, six and eight sidewalls). The vault is cast, molded, and/or in one piece. A memorial plaque impression may be cast on the vault. At least one leveling foot is provided and it may also be used with a lifting device for lifting the vault. The urn has a first end and a second end. A cover attaches to the first end. An urn attachment bracket is disposed on the urn to attach the urn end-to-end to a second urn. The urn attachment bracket may be located on the second end. Two urns may be attached end-to-end.

29 Claims, 12 Drawing Sheets

(a)

(b)

(c)

(a)

(b)

(c)

MODULAR STORAGE SYSTEM FOR STORING CREMATED REMAINS

CROSS-REFERENCE TO RELATED APPLICATION

This application is a division of U.S. patent application Ser. No. 09/250,531, filed Feb. 16, 1999, now abandoned.

FIELD OF THE INVENTION

The present invention relates generally to burial systems. More specifically, the present invention relates generally to storing cremated remains.

BACKGROUND OF THE INVENTION

The popularity of cremation as an alternative to burial has increased significantly in recent years. There are currently several ways in which to handle cremated remains. One approach is to simply scatter the remains on the ground or at sea. However, it is more common to store cremated remains in an urn. Urns can be very simple and plain or they can be very elaborate and ornate.

Urns have been stored in a variety of different ways. One approach has been to bury the urns in the ground in the same manner that coffins are buried. However, this method, like conventional burial, requires the inefficient use of cemetery land.

Another approach is to store the urns in a structure called a columbarium. A typical columbarium is nothing more than a wall containing a series of recesses for holding the urns. These recesses are referred to as niches. The front side of each niche contains a door that provides access to the urns. One or more urns can be stored side-by-side (i.e., not top-to-bottom) in the same niche behind the closed door.

The door of each niche may be made of a see-through material, such as glass, which allows for easy viewing of the urns located behind the door. In such a case, the urns are typically ornate. An alternative prior art approach uses a door made of a material such as bronze, marble, wood, or granite. The door may contain an ornate memorial plaque for identifying the urns, and the urns are often simple and plain.

The problem with using these prior art storage systems is that they require walls or buildings that are typically large and complicated structures. Furthermore, these prior art columbariums are not well suited for efficiently storing the cremated remains of a large number of individuals in a small space. As a result of these deficiencies, they are not well suited for usage at existing cemeteries where land space may be scarce.

It is desirable therefore to have a storage system for storing a large number of cremated remains in a space efficient manner. Furthermore, it is desirable to have a storage system that will efficiently utilize the limited supply of cemetery land.

Another problem with these prior art columbariums is that, because they require a wall or building, they tend to be expensive to construct and cost prohibitive for certain individuals or families. For instance, if a family wanted to have a place on their property for storing the remains of several generations of family members, it might be cost prohibitive to construct an entire wall or building. It is therefore desirable to have a storage system that is affordable under varying circumstances.

These prior art columbariums are also not conducive to easy installation or modular expansion and are not easily moved. It is therefore desirable to have a storage system for storing cremated remains that is easy to install and that allows for easy expansion and relocation if necessary, of both the urns and/or the containers in which the urns are stored.

Finally, with respect to the process of cremation, in many jurisdictions, burial is defined to occur at the time of cremation. The restrictions that apply to the burial of non-cremated remains, with respect to where such remains can finally be located, do not apply to cremated remains in these jurisdictions.

It is therefore desirable to have a storage system that is well suited to being located on a wide variety of both private and public property (including, but not limited to cemeteries), and further that can be customized to meet the needs of the particular property owner. For instance, it is desirable to have a modular system that can be easily placed in backyards or at marinas and that could be configured in such a way as to create an aesthetically pleasing arrangement.

SUMMARY OF THE PRESENT INVENTION

According to a first aspect of the invention an apparatus for storing urns includes a container which has or forms a vault. The vault has an open top and at least one chamber. Access to the at least one chamber is through the open top. A cover closes the open top, and one or more vault fasteners are provided so the container can be attached to a second container.

In one alternative embodiment the chamber or chambers are configured to hold a plurality of urns side-by-side. In another alternative embodiment the chamber or chambers are configured to hold a plurality of urns end-to-end.

According to a second aspect of the invention an apparatus for storing urns includes a container which has or forms a vault. The vault has an open top and a plurality of sidewalls. Also, the vault is configured for storing at least one of a plurality of urns along each of the plurality of sidewalls. A cover closes the open top.

According to a third aspect of the invention an apparatus for storing urns includes a container having or forming a vault. The vault has an open top and a cover closes the open top. The vault is configured for storing a plurality of urns side-by-side, and at least a portion of the plurality of urns are stored around the inside periphery of the vault.

According to a fourth aspect of the invention an apparatus for storing urns includes a plurality of containers. Each of the containers has or forms a vault that is configured for storing a plurality of urns. The vault has an open top such that access to the plurality of urns is through the open top. Two or more of the containers are attached to one another.

According to a fifth aspect of the invention an apparatus for storing urns includes a container having or forming a vault. The vault has an open top and a cover closes the open top. The vault also is or forms at least one chamber in which a plurality of urns are stored side-by-side. Access to the at least one chamber is from the open top, In an alternative embodiment one or more keyed fasteners for securing the cover to the vault are provided. In another alternative embodiment at least one vault cover lifting device is configured to remove the keyed fastener from the apparatus and to lift the cover from the vault.

In yet another alternative embodiment at least one urn spacer is inside the chamber(s) to space and locate the urns. In another alternative embodiment the urn spacer is stamped.

In another embodiment the container is cylindrical in shape. In other alternative embodiments the container has a plurality of sidewalls and substantially polygonal in shape. In various alternatives the container has three, four, five, six and eight sidewalls. In another alternative embodiment the cover is angled.

In another alternative embodiment one or more containers are adapted for side-by-side attachment to one another.

In various embodiments the vault is cast, molded, and/or in one piece.

In another alternative the container has a memorial plaque impression cast therein. The memorial plaque may be made from the stamped urn spacer.

The container includes at least one leveling foot in one embodiment. The leveling foot is also a lifting device for lifting the vault, in another embodiment.

According to a sixth aspect of the invention an apparatus for holding cremated remains includes an urn having a vessel. The vessel has a first end and a second end. A cover attaches to the first end. An urn attachment bracket is disposed on the urn to attach the urn end-to-end to a second urn.

In an alternative embodiment the urn attachment bracket is located on the second end.

In yet another alternative embodiment the apparatus of claim includes another urn. In another alternative embodiment one or more of the urns includes an urn attachment bracket disposed to attach the urns end-to-end to one another.

According to a seventh aspect of the invention an apparatus for holding cremated remains includes an urn having or forming a vessel. The vessel has a first end and a second end. A cover is attached to the first end. An urn lifting bracket is on the urn to receive an urn lifting device.

In an alternative embodiment the urn lifting device is located on the cover. In another alternative embodiment the urn lifting bracket is threaded to receive a threaded urn lifting device. In yet another alternative embodiment the cover has threads such that the cover screws on to the vessel.

Other principal features and advantages of the invention will become apparent to those skilled in the art upon review of the following drawings, the detailed description and the appended claims.

Figure 1:
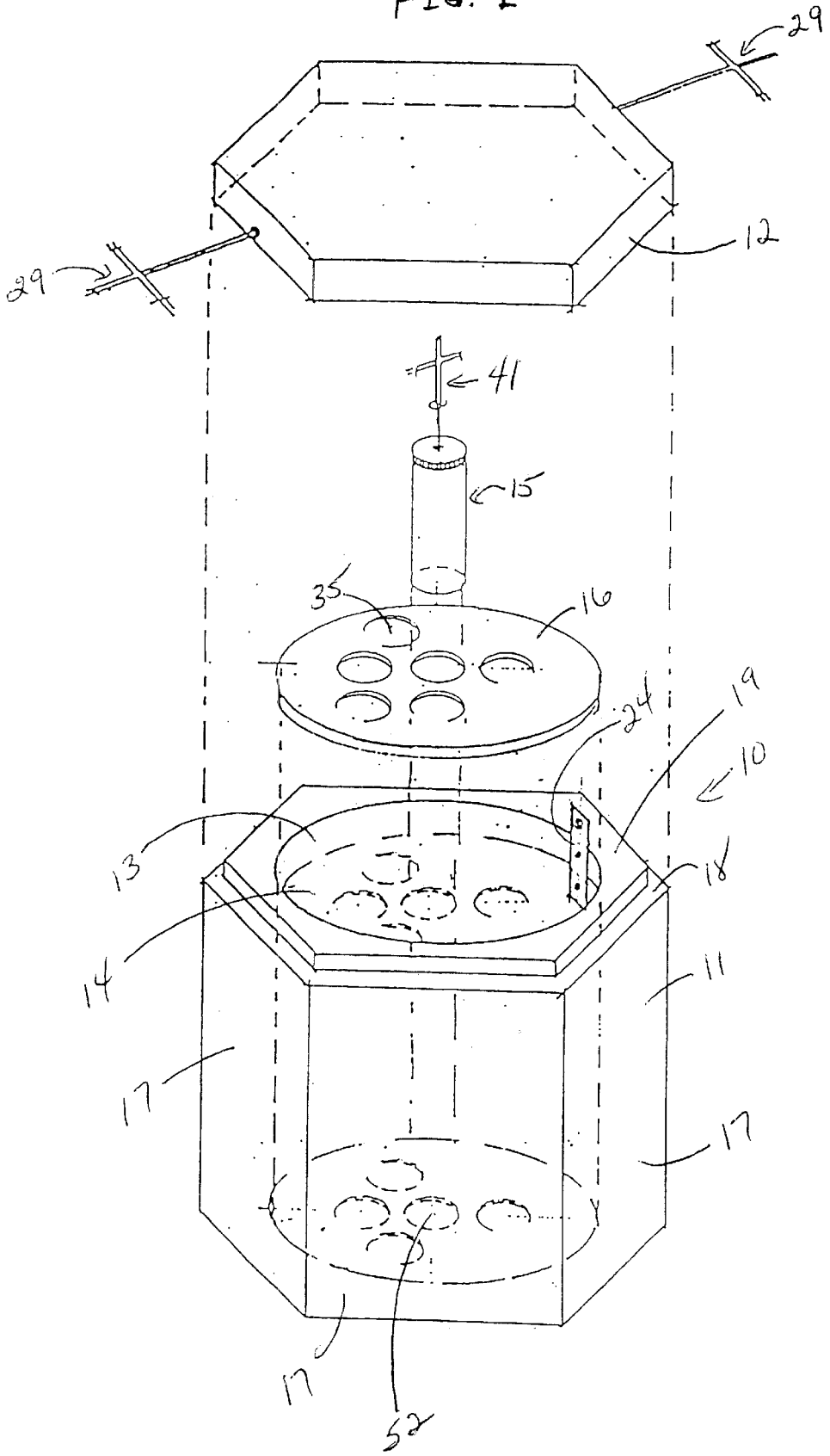
FIG. 1 shows an exploded perspective view of a single container according to the preferred embodiment of the present invention.

Before explaining at least one embodiment of the invention in detail it is to be understood that the invention is not limited in its application to the details of construction and the arrangement of the components set forth in the following description or illustrated in the drawings. The invention is capable of other embodiments or of being practiced or carried out in various ways. Also, it is to be understood that the phraseology and terminology employed herein is for the purpose of description and should not be regarded as limiting. Like reference numerals are used to indicate like components.

DETAILED DESCRIPTION OF THE PREFERRED EMBODIMENTS

While the present invention will be illustrated with reference to a particular modular system configuration and arrangement for storing cremated remains, it should be understood at the outset that the present invention is not limited to this configuration and/or arrangement.

Generally, the present invention relates to a modular storage system for storing cremated remains. The building blocks of the modular system are the urns for holding the cremated remains and the containers for storing the urns.

The preferred embodiment of the present invention includes an urn or urns for holding the cremated remains. The term urn, as used herein, refers to a structure in which cremated remains are directly held and does not include structures that are configured to hold other structures containing cremated remains. Each urn in the preferred embodiment includes a vessel for holding the remains, a cover for the top side of the urn, a bracket to aid removal of the urn from a container, and a bracket for attaching two urns together end-to-end (i.e., top-to-bottom or bottom-to-top).

The preferred embodiment of the present invention also includes a container for storing urns. The term container, as used herein, refers to any structure that includes a vault and a cover and is configured for storing a plurality of urns. The term vault, as used herein, refers to any structure configured for holding a plurality of urns wherein access to the plurality of urns is through an open top and further wherein the open top is adapted to be closed by a cover. The bottom of the container in the preferred embodiment is a vault with an internal chamber. The urns are stored inside of the chamber. Access to the chamber is through a removable top cover. The urns are stored side-by-side (with or without spaces therebetween) and can be stacked vertically end-to-end on top of each other inside the chamber.

The containers may be of various shapes and sizes and are typically aesthetically pleasing and decorative. Each container can be used alone, or it may be adapted for side-by-side attachment or end-to-end attachment to another container to form a modular system of containers. Shrubbery and plantings can be added near the containers, as well as benches for sitting and praying. In this way, a very decorative and useful arrangement can be created for storing cremated remains.

FIG. 1 shows an exploded view of a single apparatus or container 10 having a vault 11 and a cover 12 adapted for placement on vault 11. Vault 11 has an open top 13 providing access to an internal chamber 14. Chamber 14 is configured for storing a plurality of urns 15 side-by-side and, if desired, end-to-end.

The plurality of urns 15 are separated from one another inside of the chamber by way of an urn spacer 16. If needed, more than one urn spacer 16 may be used. Another type of urn spacer that is used in the preferred embodiment is urn spacer 52 which is cast as part of vault 11. Extending above the top surface 18 of vault 11 is an annular flange 19.

Figure 9:
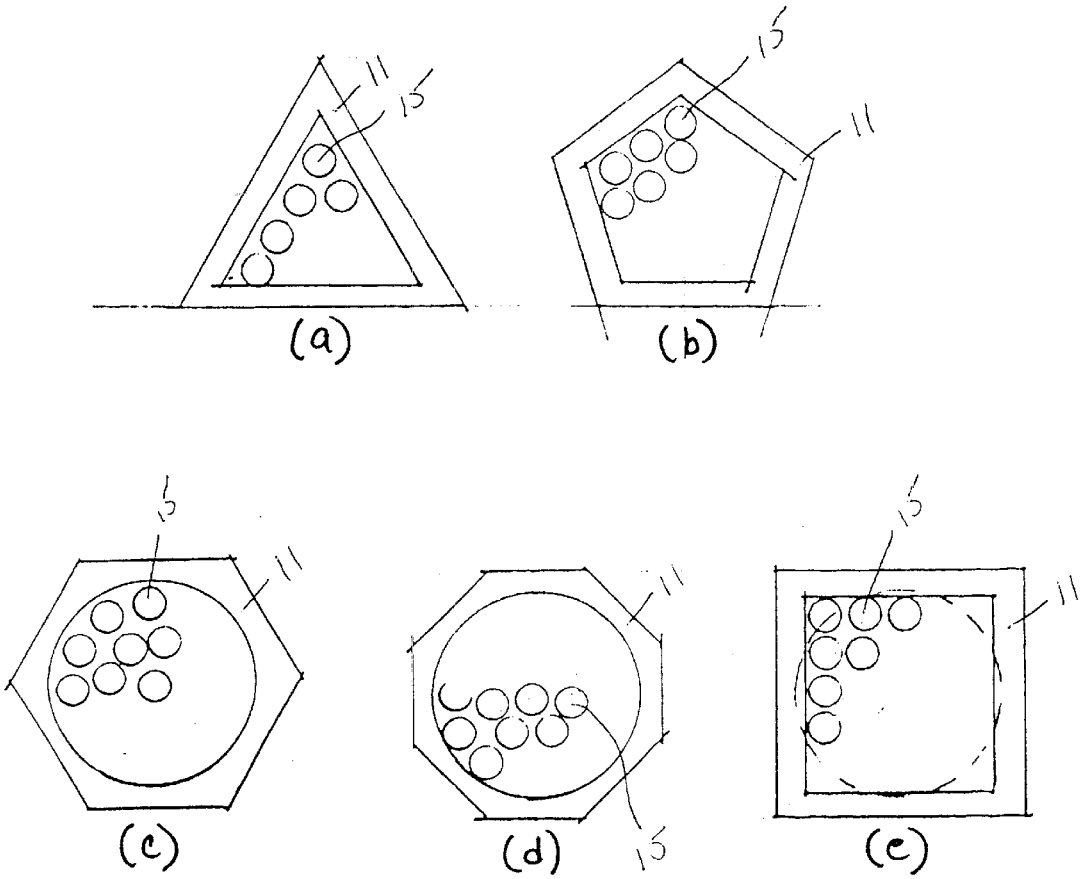
FIGS. 9*a*–9*e* show top views of open vaults of various alternatively shaped embodiments of the present invention.

Container 10 has six sidewalls 17 and is hexagonal in shape in the preferred embodiment shown in FIG. 1. Although container 10 is hexagonal in shape in the preferred embodiment, the present invention is not limited to this shape and any shape could be used. Alternative embodiments of the present invention might include, but are not limited to, containers that are cylindrical, triangular, rectangular, square, pentagonal, octagonal, or irregular in shape (see FIG. 9).

Container 10 is ideally suited for usage outdoors in cemeteries, backyards, marinas, estates, and on other property, both public and private and does not need to be located inside of a building. However, there is no reason why container 10 could not be displayed inside of a building.

Container 10 is cast in granite in the preferred embodiment, but the present invention is not limited to cast containers. Any type of container that would be suitable for storing a plurality of urns can be used, including containers that are cast, molded, or assembled from several pieces. Likewise, the present invention is not limited to granite, but rather many other types of materials can be used, including, but not limited to, concrete, marble, stone, wood, plastic, etc.

Figure 2:
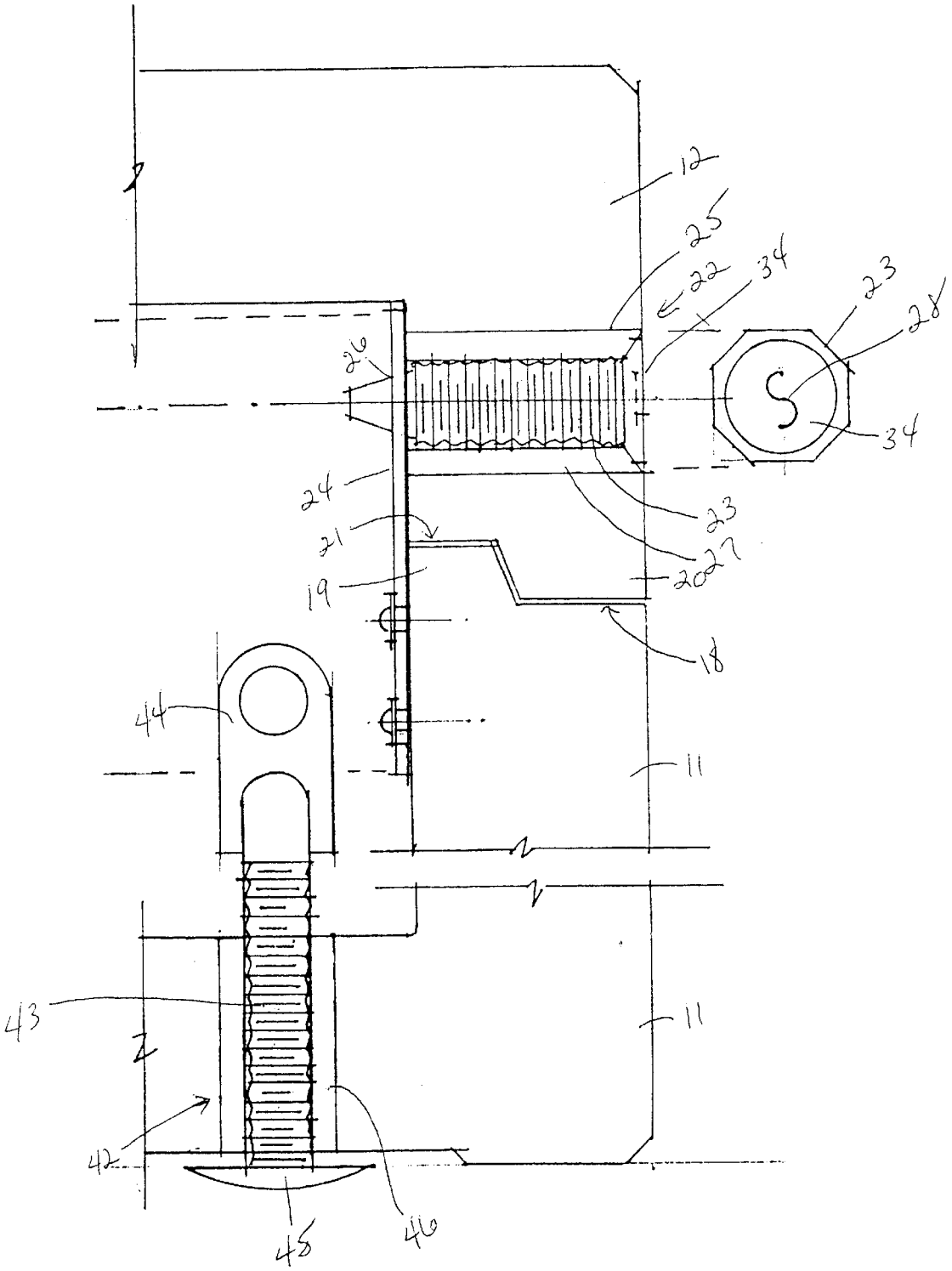
FIG. 2 shows a close-up cross sectional view of a vault and cover according to the preferred embodiment of the present invention.
Figure 3:
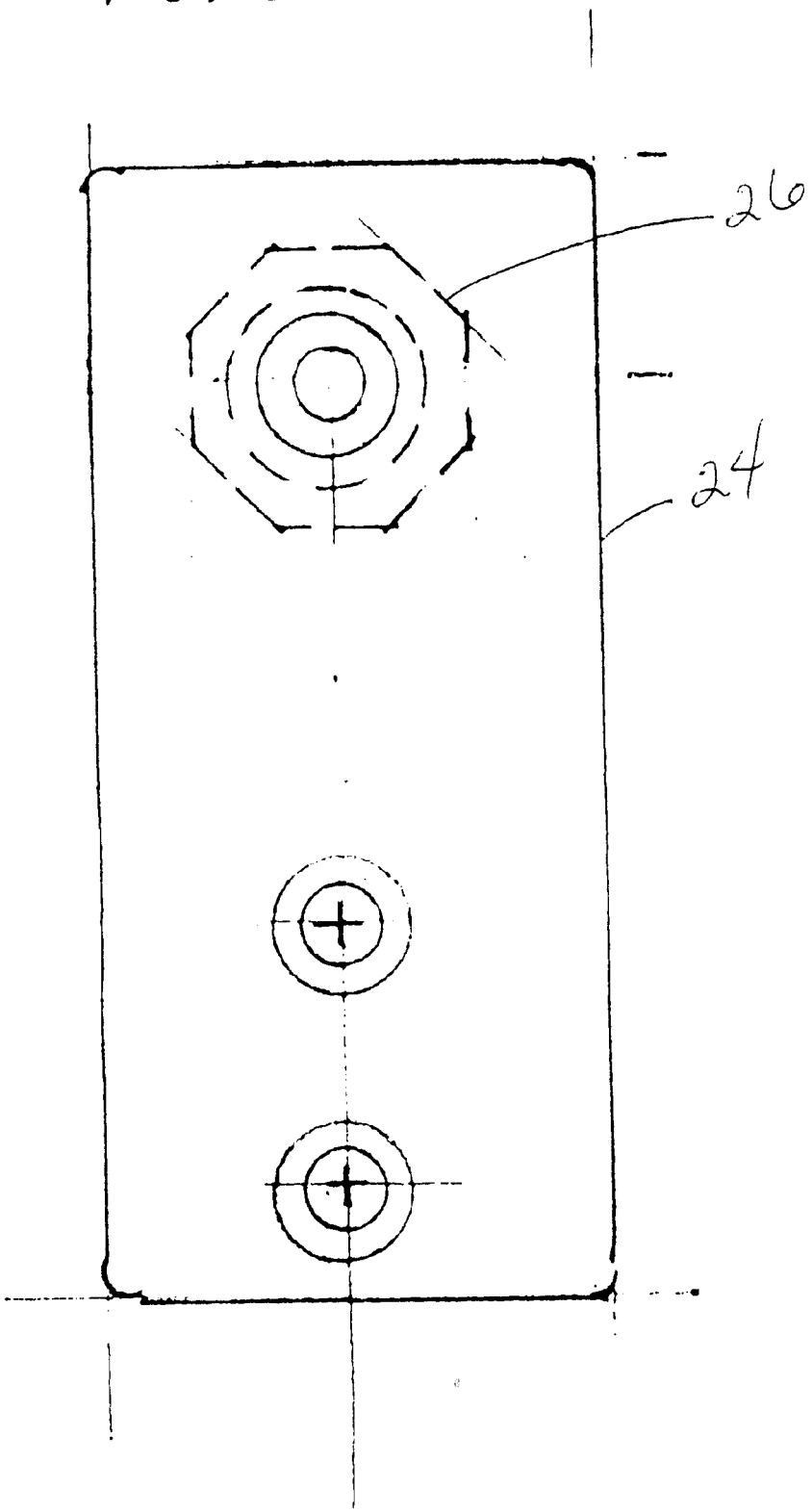
FIG. 3 shows a side view of a cover mounting plate according to the preferred embodiment of the present invention.
Figure 4:
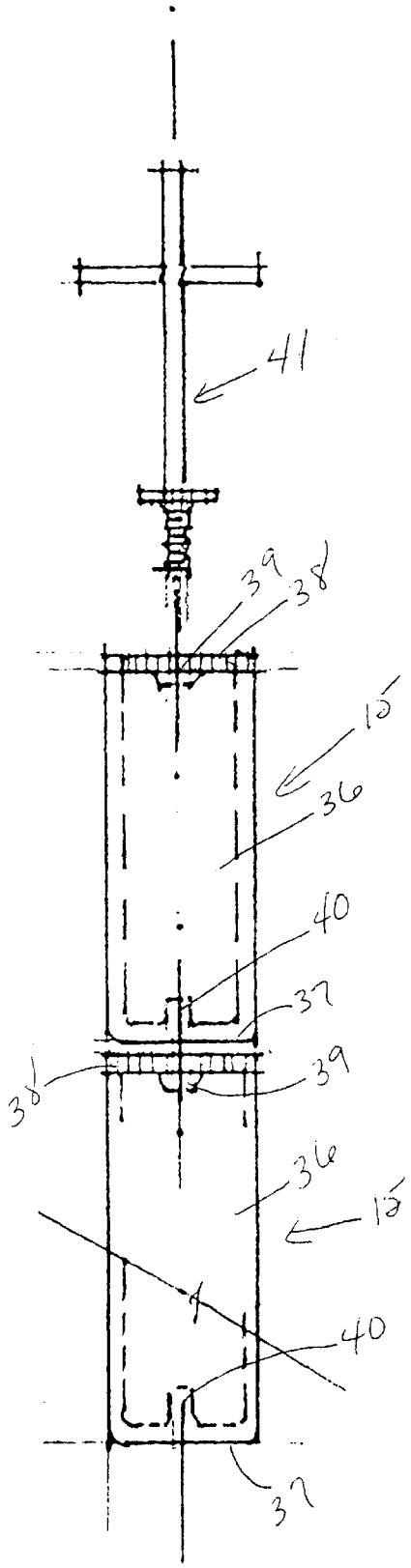
FIG. 4 shows a side view of two attached urns and an associated urn lifting device according to the preferred embodiment of the present invention.

Referring to FIG. 2, one of the sidewalls 17 of vault 11 is shown in cross section along with a portion of cover 12. The bottom edge of cover 12 contains an outer annular lip 20 that extends downward and an inner annular surface 21. When cover 12 is placed on vault 11, annular lip 20 is located on the outside of, and surrounds, flange 19. This arrangement helps keep moisture out of the interior of chamber 14. If a better seal is required, an annular gasket (not shown) could be placed on top surface 18 surrounding flange 19 or could be placed in contact with inner annular surface 21.

Once in place, cover 12 is secured to vault 11 via a plurality (preferably) of keying assemblies 22. Each keying assembly 22 consists of a keyed fastener 23 and a cover mounting plate 24 in the preferred embodiment. Each cover mounting plate 24 is secured to the inside wall of vault 11 with conventional fasteners. Once cover 12 is lowered on to vault 11, cover 12 is adjusted until each hole 25 in cover 12 is aligned with a corresponding hole 26 in each cover mounting plate 24. This alignment allows for the insertion of keyed fasteners 23.

For purposes of this disclosure, only one of the keying assemblies will be described in detail. Hole 26 in cover mounting plate 24 is sized to receive one end of keyed fastener 23 in the preferred embodiment. A threaded bushing 27 is located in hole 25 in cover 12. Keyed fastener 23, which is also threaded, is threaded into bushing 27 until the end of keyed fastener 23 engages hole 26 in cover mounting plate 24. This engagement prevents cover 12 from being removed from vault 11 without the aid of a key.

In an alternative embodiment, hole 26 in cover mounting plate 24 is threaded and keyed fastener 23 is simply inserted into hole 25 (which may or may not contain a bushing) and is thereafter threaded into hole 26 in cover mounting plate 24. In yet another embodiment, both hole 26 and hole 25 contain threads and keyed fastener 23 is threaded into both cover 12 and cover mounting plate 24.

Although the preferred embodiment incorporates two keying assemblies to secure cover 12 to vault 11, the present invention is not limited to two keying assemblies and any number of keying assemblies could be used. For instance, in an alternative embodiment, a single keying assembly could be used. Likewise, although the preferred embodiment uses a particular structural configuration for the keyed fastener, the term keyed fastener, as used herein, refers to any structure which secures cover 12 to vault 11 and which requires a custom tool (i.e. key) for removal. Finally, the actual keying configuration 28 of keyed fastener 23 in the preferred embodiment is an "s" shaped configuration as shown in FIG. 2, however any keying configuration could be used.

Figure 5:
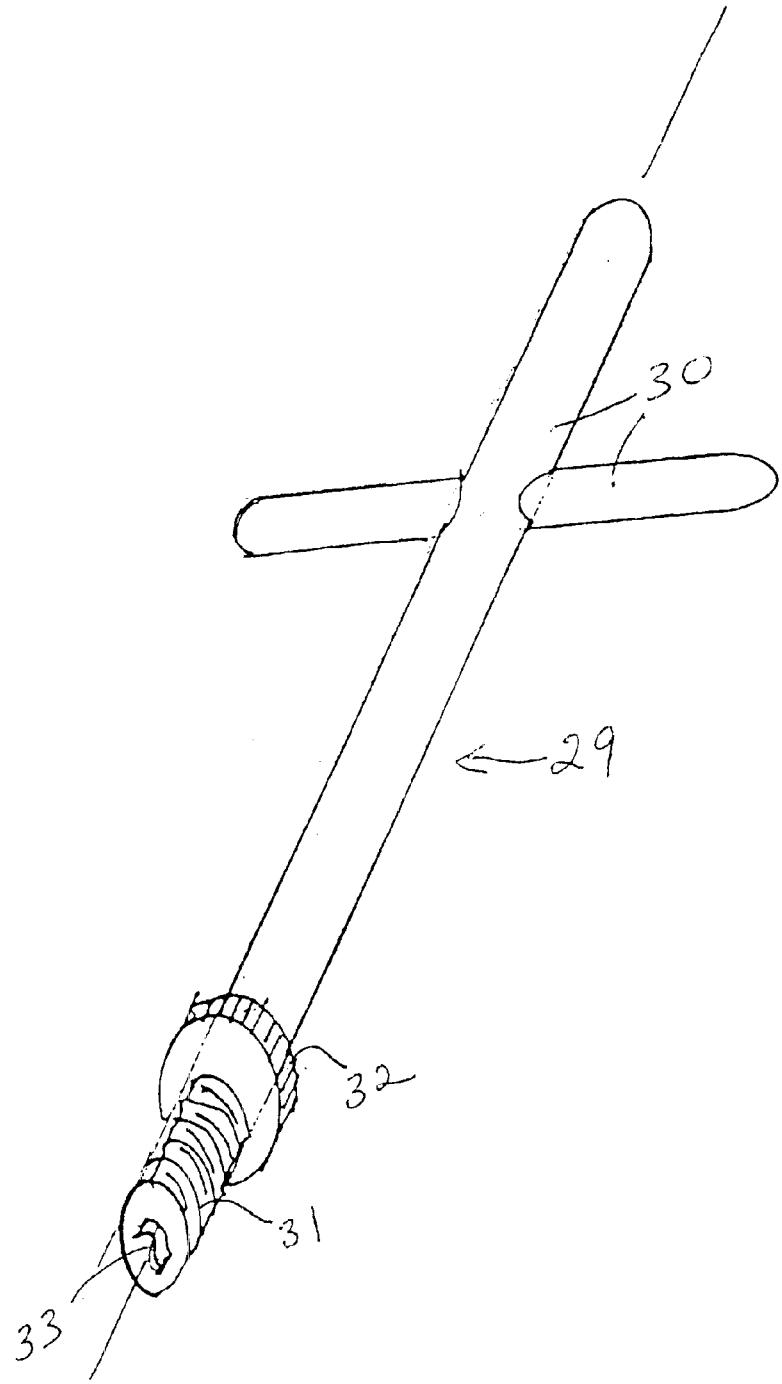
FIG. 5 shows a perspective view of a vault cover lifting. device according to the preferred embodiment of the present invention.

FIG. 5 shows the vault cover lifting device 29 that is used to remove cover 12 from vault 11. Lifting device 29 is preferably made of brass or a coated metal and includes a cross shaped handle 30, a threaded end 31, a snugger nut 32 threaded on threaded end 31, and a key 33 located at the end of lifting device 29. The key 33 is part of the lifting device 29 in the preferred embodiment and its keying configuration is also "s" shaped to match the keying configuration of keyed fastener 23. In an alternative embodiment, the key and lifting device are separate pieces.

Removal of cover 12 from vault 11 is accomplished in the following manner in the preferred embodiment. Key 33 on lifting device 29 is first inserted into the keyed end 34 of keyed fastener 23 and keyed fastener 23 is extracted from cover 12. Next, threaded end 31 of lifting device 29 is threaded into cover 12.

Figure 6:
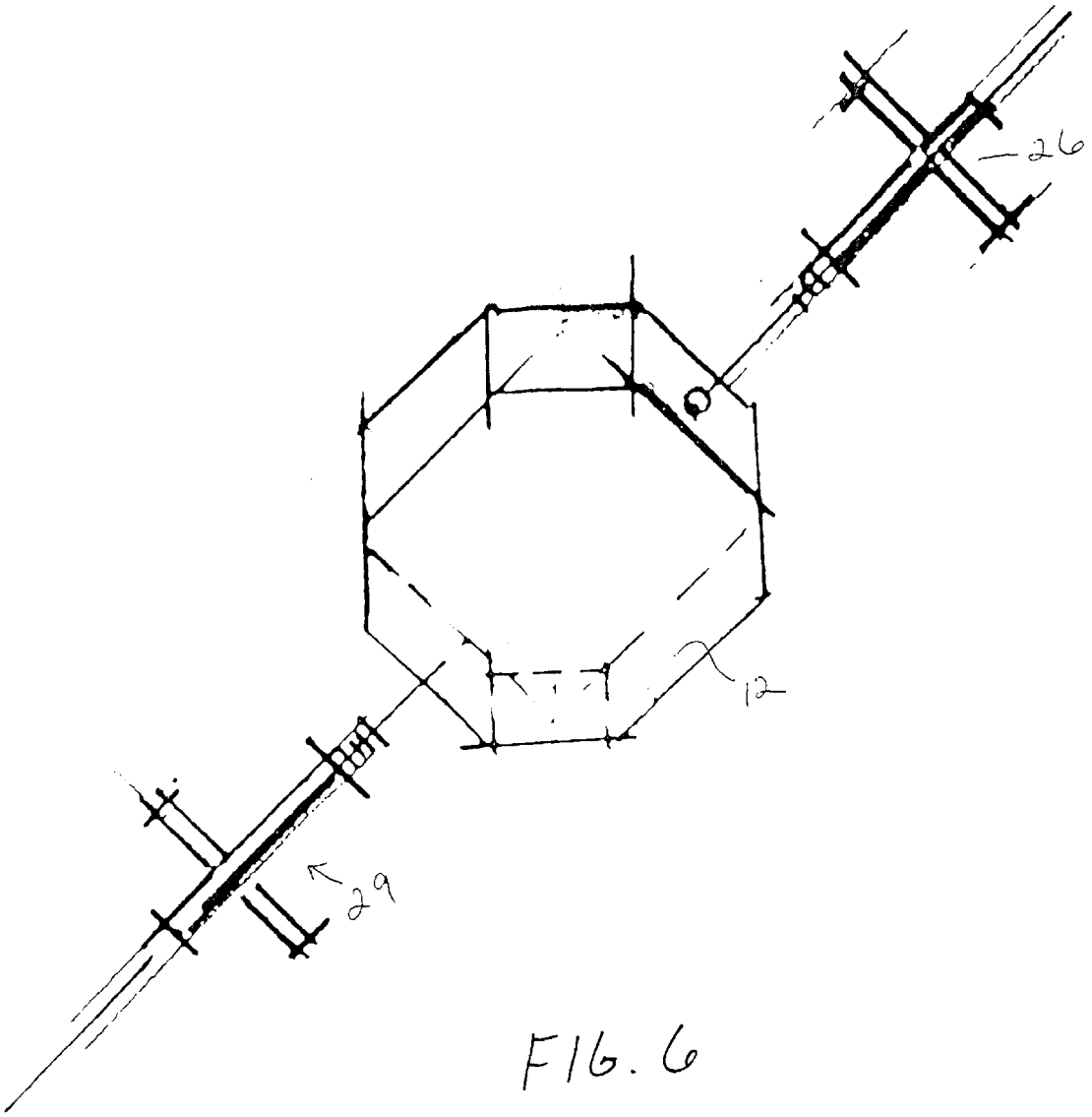
FIG. 6 shows a perspective view of a cover and an associated vault cover lifting devices according to the preferred embodiment of the present invention.

Prior to removal of cover 12 from vault 11, it is desirable to have lifting device 29 tightly secured to cover 12 and to have handle 30 secured in a substantially horizontal orientation (see FIG. 6). Once lifting device 29 is threaded into cover 12 far enough to support removal of cover 12 and is positioned such that handle 30 is substantially horizontal, snugger nut 32 is rotated on threaded end 31 toward cover 12 to tightly secure lifting device 29 to cover 12 and to prevent rotation of handle 30 from a horizontal orientation during removal of cover 12.

Although a particular vault cover lifting device structure and configuration are shown in the preferred embodiment, the present invention is not limited to this structure or configuration. The term vault cover lifting device, as used herein, includes any structure or configuration which is configured for removing cover 12 from vault 11.

Likewise, although the general shape of the vault cover lifting device is a cross in the preferred embodiment, the present invention is not limited to this shape and other shapes can be used. Finally, although certain materials for making the vault cover lifting device are enumerated herein, the present invention is not limited to these materials and other materials can be used.

Figure 7:
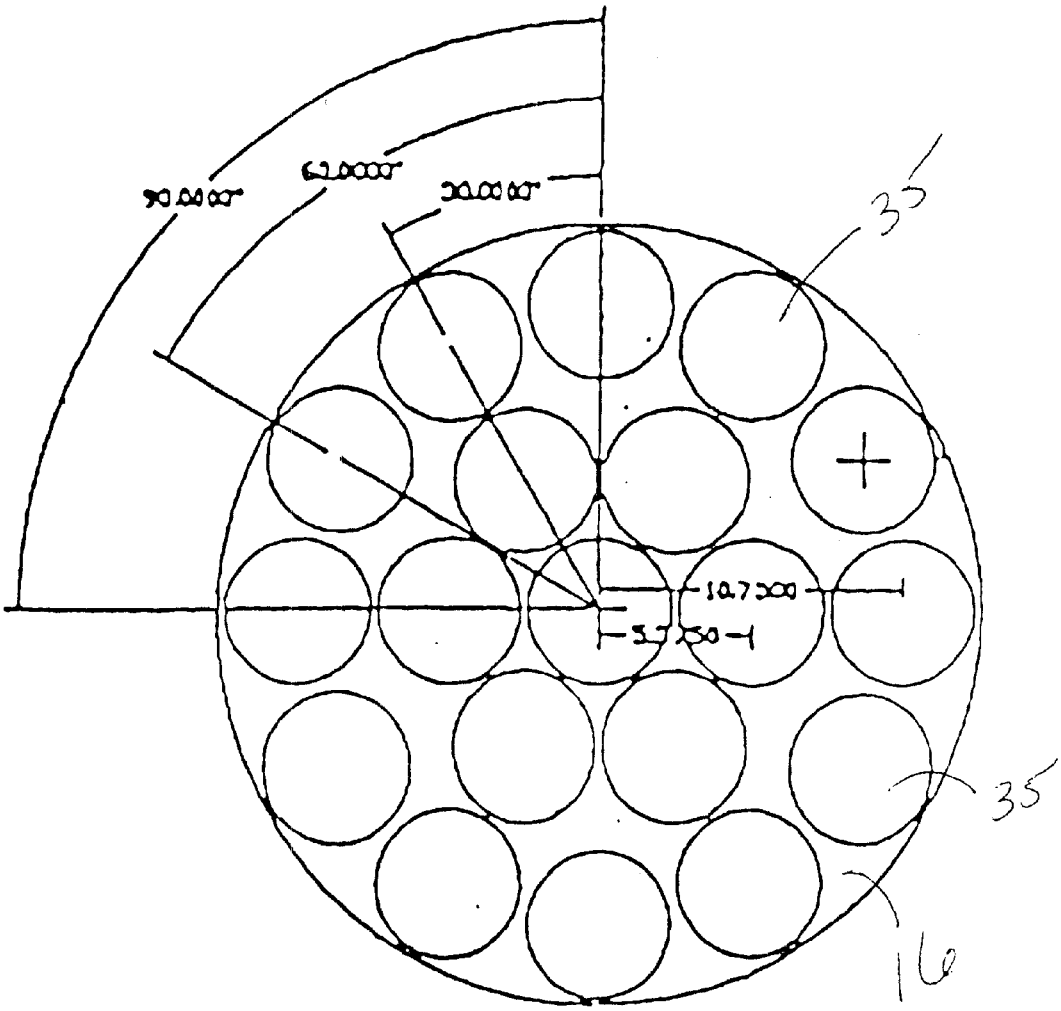
FIG. 7 shows a top view of an urn spacer according to the preferred embodiment of the present invention.

In the preferred embodiment, urn spacer 16 is a round disk (see FIG. 7) preferably made from brass or some other metal and has circular holes 35 (or, in an alternative embodiment, holes of a different shape) for receiving urns 15 and is a separate piece that is inserted into chamber 14. Urn spacer 16 is supported. inside of chamber 14 by way of brackets (not shown) that extend inward from the chamber walls.

Urn spacer 16, being a flat disk structure in the preferred embodiment, can be manufactured by way of a simple stamping process, but other processes can be used to make urn spacers. Each circular piece, each of which corresponds to one of the holes 34, that is removed can be used later as an identification plate as is described in more detail later in this disclosure.

A second urn spacer 52 incorporated into the preferred embodiment includes a series of circular recesses cast into the bottom inside wall of chamber 14.

Urn spacer 16 allows for the storage of at least one urn adjacent each of the sidewalls 17 and further allows for a plurality of urns to be stored around the inside periphery of the vault. In this way the use of urn spacer 16 maximizes the number of urns that can be stored in container 10.

Although the preferred embodiment shows a particular structure, material, and configuration for both urn spacer 16 and the second urn spacer, the present invention is not limited to these structures, materials, and/or configurations. The term urn spacer, as used herein, includes any structure and/or configuration, regardless of whether or not the structure is a separate piece from the vault, which provides for and maintains separation between each urn 15 stored side-by-side in chamber 14.

Container 10 is designed to hold a plurality of urns 15. Each urn 15 in the preferred embodiment is cylindrical in shape, although the present invention is not limited to cylindrically shaped urns. In an alternative embodiment urn 15 is polygonal. Each urn 15 includes a vessel 36 having a bottom end 37, a cover 38, an urn lifting bracket 39 on cover 38, and an urn attachment bracket 40 on bottom end 37 in the preferred embodiment.

Although a particular urn structure and configuration are disclosed in the preferred embodiment, the present invention is not limited to this structure and/or configuration.

Cover 38 is removable and includes threads (not shown) for screwing into vessel 36 in the preferred embodiment. In an alternative embodiment, cover 38 is attached to-vessel 36 with a fastener, such as a screw or bolt.

Cover 38 includes an urn lifting bracket 39 (in the form of a threaded recess in the preferred embodiment) in its top surface. Urn lifting bracket 39 is provided so that an urn lifting device 41 can be threaded into urn lifting bracket 38 to thereby facilitate the removal of urn 15 through open top 13 of vault 11. The term urn lifting device, as used herein, includes any structure or configuration which is configured for removing an urn or urns from a container.

When not in use, urn lifting bracket 38 can be filled by using a threaded plug (not shown), such as a screw or bolt. Additionally, the threaded plug can be specially keyed so that a custom tool (i.e. key) is needed to remove the plug from urn lifting bracket 38.

Urn 15 also includes urn attachment bracket 40 (also in the form of a threaded recess in the preferred embodiment) on end 37. Urn attachment bracket 40 is adapted to receive a threaded rod (not shown) for attaching one urn 15 to a second urn 15. The two urns are attached by threading the threaded rod into both the urn lifting bracket 39 on cover 38 of the first urn 15 and into the urn attachment bracket 40 on end 37 of the second urn 15. In this manner, the two urns can be attached end-to-end.

Although particular structures for the urn lifting bracket and the urn attachment bracket are disclosed in the preferred embodiment, the present invention is not limited to these structures. The term urn lifting bracket, as used herein, includes any structure which is adapted for receiving a tool which is used to remove urns from a vault, including, but not limited to, eye bolts, hooks, etc. The term urn attachment bracket, as used herein, includes any structure which is adapted for attaching one urn to a second urn, with or without the need for an additional fastener, including, but not limited to, bolts, hooks, studs, recesses, etc.

Urn lifting bracket 39 in the preferred embodiment is also an urn attachment bracket. It is not necessary, however, that the urn lifting bracket also be an urn attachment bracket. For instance, in an alternative embodiment of the present invention, both an urn lifting bracket and a separate urn attachment bracket are located on cover 38.

It is also not necessary that the urn attachment bracket on each urn to be attached be identical. For instance, in yet another embodiment of the present invention, the urn attachment bracket on one urn is configured as a "male" bracket and the urn attachment bracket on the second urn is configured as a "female" bracket which is adapted to mate with the "male" bracket.

Vault 11 in the preferred embodiment is hexagonal in shape. Likewise, cover 12 in the preferred embodiment is flat and hexagonal in shape. As previously mentioned, however, the present invention is not limited to containers of this shape and many other shapes and configurations for both the vault and the cover could be used.

FIGS. 10*a*–10*e* show several different container configuration embodiments of the present invention. Each of these embodiments is shown sitting on a foundation. Although a foundation is not required in order to use a container, it may be useful to have one under the container.

Figure 10:
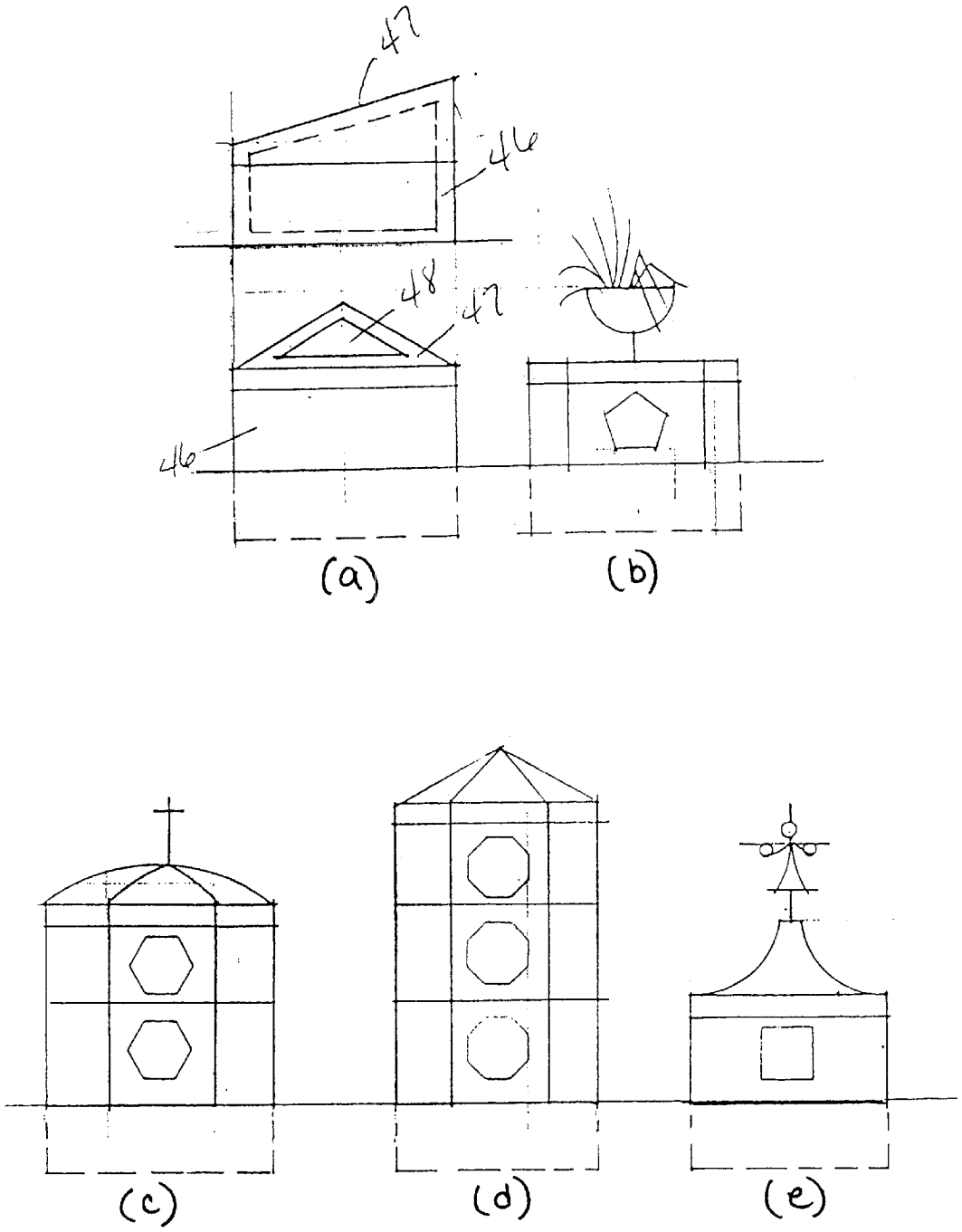
FIGS. 10*a*–10*e* show elevation views of various container embodiments of the present invention.
Figure 11:
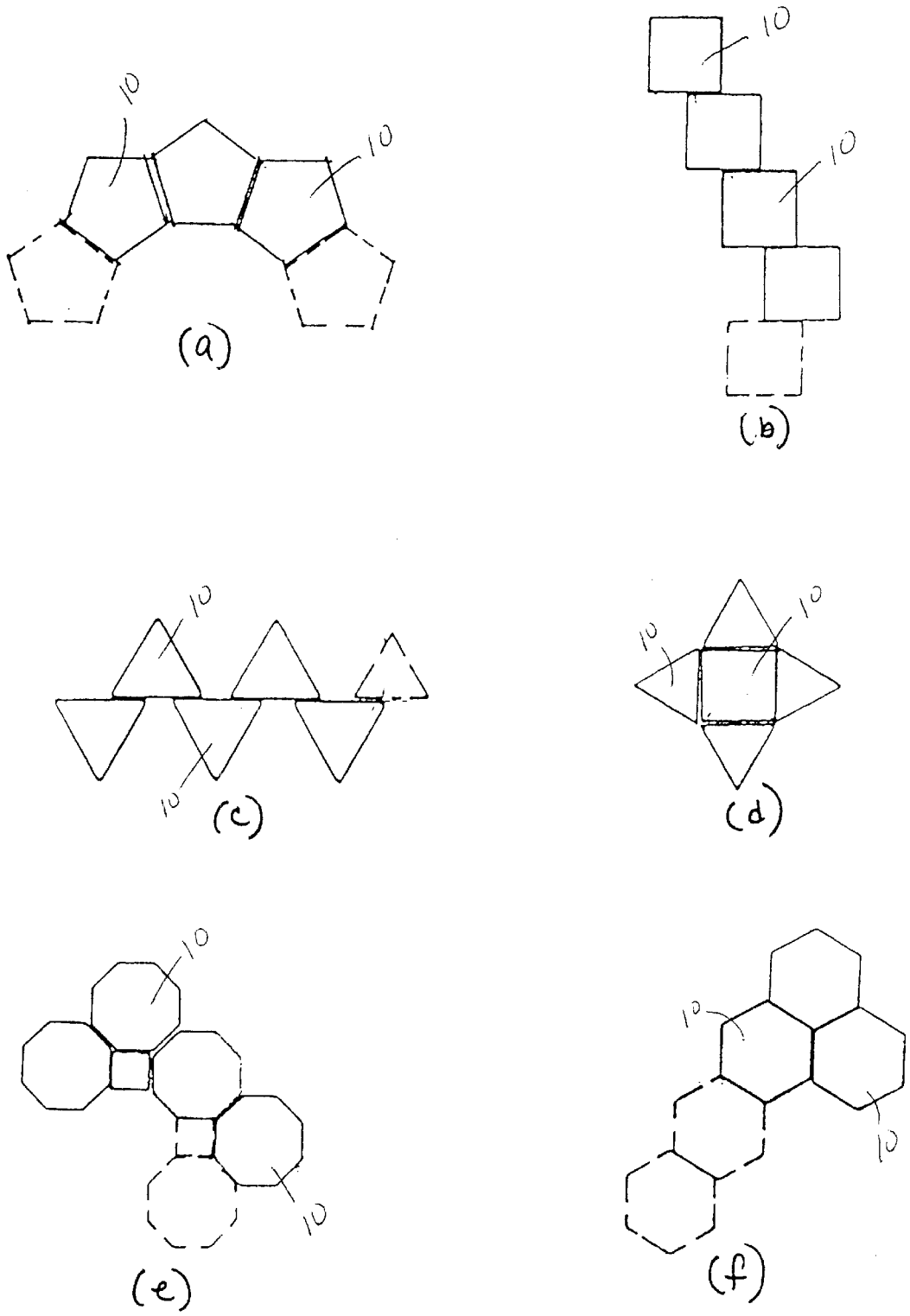
FIGS. 11*a*–11*f* show top views of various modular system embodiments of the present invention.

FIG. 10*a* shows a triangularly shaped vault 46 having a triangularly shaped cover 47. Cover 47 is placed at an angle in this embodiment to allow for easy viewing of memorial plaque 48 located on cover 47. However, it is not necessary that cover 47 be angled and in an alternative embodiment, cover 47 is horizontal. Additionally, FIGS. 10*b*–10*e* show various alternative cover embodiments of the present invention.

Figure 8:
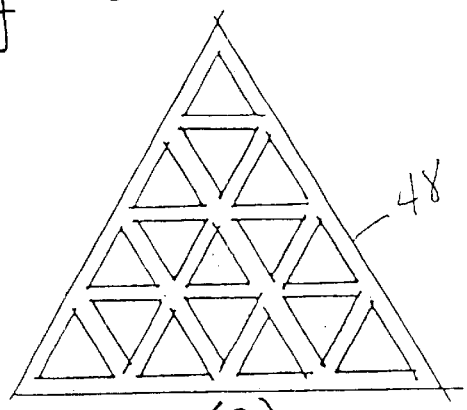
FIGS. 8*a*–8*c* show top views of several memorial plaque embodiments of the present invention.
Figure 8:
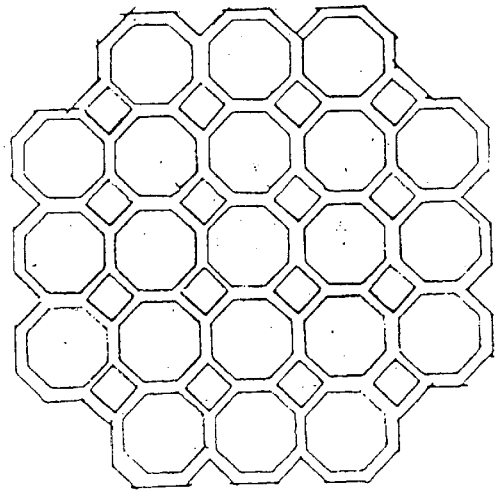
Figure 8:
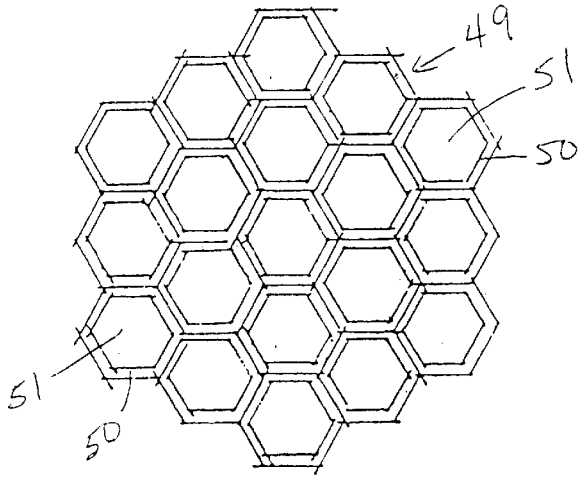
Figure 12:
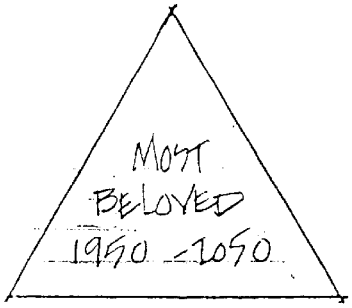
FIGS. 12*a*–12*c* show various memorial plaques in accordance with the present invention.
Figure 12:
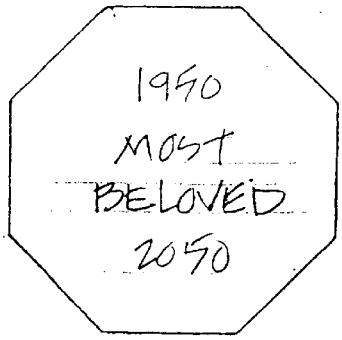
Figure 12:
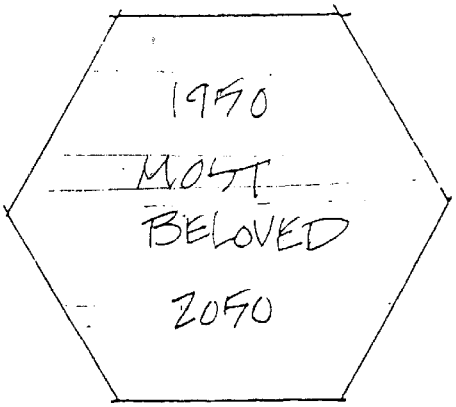

Memorial plaque 48 as shown in FIG. 10*a* is provided to allow for identification of the cremated remains contained in each container 10. Other memorial plaque embodiments of the present invention are shown in FIGS. 8*a*–8*c*. In general, each memorial plaque is made as a separate piece, as shown in FIGS. 12*a*–12*c* and are attached to the container with some type of adhesive or fastener. The memorial plaque can be attached to cover 12 or it can be mounted to the outside of vault 11. In an alternative embodiment, the memorial plaque is made as a cast or molded impression as part of the vault or cover.

Referring to FIG. 8*c*, memorial plaque 49 is shown containing nineteen insert locations 50 for mounting a plurality of ID plates 51. Memorial plaque 49 can be initially provided with insert locations 50 empty, or it can be provided with blank ID plates 51 already mounted at each insert location 50.

Each ID plate 51 corresponds to one urn location inside of chamber 14 and therefore there is a one-to-one mapping between the location of each ID plate 51 on memorial plaque 49 and the location of each urn 15 located inside of chamber 14. Each ID plate 51 will identify the particular individual or individuals whose cremated remains are contained in the urn that corresponds to the location of that particular ID plate 51.

Memorial plaque 49 can be made of any suitable material, such as plastic, stone, or metal. In the event that urn insert 16 is manufactured by a stamping process, the waste pieces that are removed to provide the holes 34 can be used as ID plates 51.

Leveling feet 42 are provided on the bottom of container 10 to allow for initial leveling of container 10 at installation and to facilitate later leveling if the ground or foundation beneath container 10 settles. Each leveling foot 42 in the preferred embodiment includes a threaded rod 43, an eyelet 44 at one end of the threaded rod 43, and a pad 45 at the other end of threaded rod 43.

Each leveling foot is threaded into a threaded bushing 46 that is inserted into the bottom of vault 11. To raise or lower each leveling foot 42 in the preferred embodiment, a rod (not shown) is inserted into eyelet 44 and turned to raise or lower the leveling foot as needed. Eyelet 44 on each leveling foot 42 also provides a convenient device for lifting vault 11 during installation. In an alternative embodiment, the leveling foot and the vault lifting device are separate structures.

Although a particular structure for the leveling feet is disclosed in the preferred embodiment, the present invention is not limited to this structure. The term leveling foot, as used herein, includes any structure which is adapted for leveling the container.

As previously mentioned, the present invention is not limited to a single container for storing urns. Rather the present invention encompasses the use of a plurality of containers in combination to form a modular system for storing the cremated remains of a large number of individuals. FIGS. 11*a*–11*f* illustrate several modular system embodiments of the present invention. It should be understood at the outset that the present invention is not limited to only those embodiments illustrated in FIGS. 11*a*–11*f* and that those particular embodiments are only included for illustration purposes.

Two or more containers, when combined to form a modular system of containers, can either be physically attached to each other or can be left unattached. If it is desired that each of the containers be attached, vault fasteners can be added to each container at the factory to provide for such attachment. For instance, in the preferred embodiment, holes are predrilled at the factory such that it is only necessary to attach each of the containers in the field with conventional fasteners, such as bolts.

Alternatively, if one of the containers to be attached is already in the field and it is desired to add a second or third container to form a modular system; the container in the field can be modified in the field by adding a vault fastener while the new additional containers can be shipped ready for attachment from the factory. In this way, the two containers can be readily attached in the field.

Although the preferred embodiment discloses a particular type of vault fastener (i.e. holes and bolts) for attaching two vaults together, the preferred embodiment is not limited to this type of vault fastener. The term vault fastener, as used herein, includes any structure that can be used to attach two vaults together and shall include, but is not limited to, nuts, bolts, holes, adhesives, and other structures used to affix or attach two vaults together.

Numerous modifications may by made to the present invention which still fall within the intended scope hereof. Thus, it should be apparent that there has been provided in accordance with the present invention a modular system for storing cremated remains that satisfies the objectives and advantages set forth above. Although the invention has been described in conjunction with specific embodiments thereof, it is evident that many alternatives, modifications and variations will be apparent to those skilled in the art. Accordingly, it is intended to embrace all such alternatives, modifications and variations that fall within the spirit and broad scope of the appended claims.

What is claimed is:

1. An apparatus comprising:

a container having a vault, wherein the vault has an open top and at least one chamber and further wherein access to the at least one chamber is through the open top;

a cover disposed to close the open top;

at least one vault fastener disposed such that the container can be attached to a second container using the at least one vault fastener;

first and second urns disposed end-to-end in the at least one chamber, wherein the first urn is physically attached to the second urn such that the first urn and the second urn can be removed from the at least one chamber together.

2. The apparatus of claim 1 wherein the at least one chamber is configured to hold a plurality of urns side-by-side.

3. The apparatus of claim 2 wherein the apparatus further includes at least one urn spacer disposed inside of the at least one chamber to maintain separation between the plurality of urns.

4. The apparatus of claim 1 further including a plurality of urns disposed side-by-side in the at least one chamber.

5. An apparatus comprising:

a container having a vault, wherein the vault has an open top and a plurality of sidewalls and further wherein the vault is configured for storing at least one of a plurality of urns along each of the plurality of sidewalls;

a cover disposed to close the open top; and first and second urns disposed end-to-end in the vault, wherein the first urn is physically attached to the second urn such that the first urn and the second urn can be removed from the vault together.

6. The apparatus of claim 5 further including the plurality of urns disposed side-by-side in the vault.

7. An apparatus comprising:

a container having a vault, wherein the vault has an open top and further wherein the vault is configured for storing at least a portion of a plurality of urns side-by-side around the inside periphery of the vault;

a cover disposed to close the open top; and first and second urns disposed end-to-end in the vault, wherein the first urn is physically attached to the second urn such that the first urn and the second urn can be removed from the vault together.

8. The apparatus of claim 7 further comprising at least one urn spacer disposed inside of the vault to maintain separation between the plurality of urns.

9. The apparatus of claim 7 further including the plurality of urns disposed side-by-side in the vault.

10. The apparatus of claim 9 further comprising at least one urn spacer disposed inside of the vault to maintain separation between the plurality of urns.

11. An apparatus comprising:

a container having a vault, wherein the vault has an open top and at least one chamber configured for storing a plurality of urns side-by-side and further wherein access to the at least one chamber is from the open top;

a cover disposed to close the open top; and first and second urns disposed end-to-end in the at least one chamber, wherein the first urn is physically attached to the second urn such that the first urn and the second urn can be removed from the at least one chamber together.

12. The apparatus of claim 11 further including the plurality of urns disposed side-by-side in the at least one chamber.

13. The apparatus of claim 12 further comprising at least one urn spacer disposed inside of the at least one chamber to maintain separation between the plurality of urns.

14. The apparatus of claim 11 further comprising at least one urn spacer disposed inside of the at least one chamber to maintain separation between the plurality of urns.

15. An apparatus comprising:

container having a vault, wherein the vault has an open top and at least one chamber configured for storing a plurality of urns side-by-side and further wherein access to the at least one chamber is from the open top;

a cover disposed to close the open top; and a first urn disposed in the at least one chamber, wherein the first urn includes an urn attachment bracket disposed to physically attach the first urn end-to-end to a second urn such that the first urn and the second urn can be removed from the at least one chamber together.

16. The apparatus of claim 15 wherein the first urn further includes an urn lifting bracket disposed on the first urn to receive an urn lifting device.

17. The apparatus of claim 15 further including the second urn disposed in the at least one chamber, wherein the first urn is physically attached to the second urn such that the first urn and the second urn can be removed from the at least one chamber together.

18. The apparatus of claim 15 further including the plurality of urns disposed side-by-side in the at least one chamber.

19. The apparatus of claim 18 further comprising at least one urn spacer disposed inside of the at least one chamber to maintain separation between the plurality of urns.

20. The apparatus of claim 15 further comprising at least one urn spacer disposed inside of the at least one chamber to maintain separation between the plurality of urns.

21. The apparatus of claim 15 further comprising at least one keyed fastener for securing the cover to the vault.

22. The apparatus of claim 21 further comprising at least one vault cover lifting device configured to remove the keyed fastener from the apparatus and further configured to lift the cover from the vault.

23. The apparatus of claim 15 wherein the cover is angled.

24. The apparatus of claim 15 further comprising at least one vault fastener disposed such that the container can be attached to a second container using the at least one vault fastener.

25. The apparatus of claim 15 further comprising at least one additional container thereby forming a plurality of containers.

26. The apparatus of claim 25 wherein each of the plurality of containers is adapted to attach to at least one other of the plurality of containers.

27. The apparatus of claim 15 wherein the vault is one piece.

28. The apparatus of claim 15 further comprising at least one leveling foot.

29. The apparatus of claim 28 wherein the at least one leveling foot is also a lifting device for lifting the vault.

* * * * *